US010837318B2

(12) United States Patent
Glahn et al.

(10) Patent No.: US 10,837,318 B2
(45) Date of Patent: Nov. 17, 2020

(54) BUFFER SYSTEM FOR GAS TURBINE ENGINE

(71) Applicant: United Technologies Corporation, Farmington, CT (US)

(72) Inventors: Jorn Axel Glahn, Manchester, CT (US); Taryn Narrow, Glastonbury, CT (US); Anthony Spagnoletti, Newington, CT (US); Francis Parnin, Suffield, CT (US); Justin W. Heiss, Glastonbury, CT (US)

(73) Assignee: RAYTHEON TECHNOLOGIES CORPORATION, Farmington, CT (US)

( * ) Notice: Subject to any disclaimer, the term of this patent is extended or adjusted under 35 U.S.C. 154(b) by 130 days.

(21) Appl. No.: 16/242,345

(22) Filed: Jan. 8, 2019

(65) Prior Publication Data

US 2020/0217220 A1 Jul. 9, 2020

(51) Int. Cl.
*F01D 25/18* (2006.01)
*F01D 25/16* (2006.01)

(52) U.S. Cl.
CPC ..... *F01D 25/183* (2013.01); *F01D 25/162* (2013.01); *F05D 2240/50* (2013.01); *F05D 2240/55* (2013.01); *F05D 2260/98* (2013.01)

(58) Field of Classification Search
CPC ..... F01D 25/183; F01D 25/18; F01D 25/16; F01D 25/162; F05D 2240/50; F05D 2240/55; F05D 2260/98
See application file for complete search history.

(56) References Cited

U.S. PATENT DOCUMENTS

| | | | | |
|---|---|---|---|---|
| 4,561,246 | A * | 12/1985 | Hovan | F01D 25/125 165/51 |
| 4,645,415 | A * | 2/1987 | Hovan | F01D 25/125 415/115 |
| 6,470,666 | B1 * | 10/2002 | Przytulski | F01D 25/125 184/6.11 |
| 7,591,631 | B2 * | 9/2009 | Hendricks | F01D 11/04 415/111 |
| 8,366,382 | B1 | 2/2013 | Muldoon et al. | |
| 10,036,508 | B2 * | 7/2018 | Bordne | F02C 7/06 |
| 2006/0123795 | A1 * | 6/2006 | Fish | F01D 11/04 60/772 |
| 2008/0003097 | A1 * | 1/2008 | Hendricks | F01D 11/04 415/115 |
| 2013/0078091 | A1 * | 3/2013 | Rees | F16J 15/4472 415/230 |
| 2016/0201848 | A1 * | 7/2016 | Bordne | F01D 25/18 137/808 |

(Continued)

FOREIGN PATENT DOCUMENTS

| | | |
|---|---|---|
| EP | 3388636 A1 | 10/2018 |
| EP | 3396119 A1 | 10/2018 |

*Primary Examiner* — Moshe Wilensky
*Assistant Examiner* — Joshua R Beebe
(74) *Attorney, Agent, or Firm* — Carlson, Gaskey & Olds, P.C.

(57) ABSTRACT

This disclosure relates to a buffer system for a gas turbine engine. An exemplary gas turbine engine includes, among other features, a buffer manifold in an intershaft region. The buffer manifold is configured to direct a flow of air between a first air seal and a first oil seal, and to direct another flow of air between a second air seal and a second oil seal.

8 Claims, 3 Drawing Sheets

(56) References Cited

U.S. PATENT DOCUMENTS

| | | | | |
|---|---|---|---|---|
| 2016/0363224 | A1* | 12/2016 | Deterre | F01D 25/16 |
| 2018/0094543 | A1* | 4/2018 | Fang | F01D 25/18 |
| 2018/0128319 | A1 | 5/2018 | Duffy et al. | |
| 2018/0306044 | A1 | 10/2018 | Witlicki et al. | |
| 2018/0340546 | A1* | 11/2018 | Lin | F01D 25/183 |

* cited by examiner

BUFFER SYSTEM FOR GAS TURBINE ENGINE

STATEMENT REGARDING GOVERNMENT SUPPORT

This invention was made with Government support awarded by the United States. The Government has certain rights in this invention.

BACKGROUND

A gas turbine engine typically includes a fan section, a compressor section, a combustor section, and a turbine section. Air entering the compressor section is compressed and delivered into the combustor section where it is mixed with fuel and ignited to generate a high-speed exhaust gas flow. The high-speed exhaust gas flow expands through the turbine section to drive the compressor and the fan section. The compressor section typically includes low and high pressure compressors, and the turbine section includes low and high pressure turbines.

A gas turbine engine also includes bearings that support rotatable shafts. The bearings require lubricant. Various seals may be utilized near the rotating shafts of the engine, such as to contain oil within oil fed areas of the engine including bearing compartments. A pressure outside of a bearing compartment that contains the bearings is typically maintained at a higher pressure than the pressure within the bearing compartment to assist in retaining the lubricant within the bearing compartment.

SUMMARY

A gas turbine engine according to an exemplary aspect of the present disclosure includes, among other things, a high pressure compressor configured to provide a flow of air to an intershaft region between a first shaft and a second shaft concentric with the first shaft, a hearing compartment, a first air seal configured to seal between the first shaft and the bearing compartment, a first oil seal configured to seal between the first shaft and the bearing compartment, a second air seal configured to seal between the second shaft and the bearing compartment, a second oil seal configured to seal between the second shaft and the bearing compartment, and a buffer manifold in the intershaft region. The buffer manifold is configured to direct a flow of air between the first air seal and the first oil seal, and to direct another flow of air between the second air seal and the second oil seal.

In a further non-limiting embodiment of the foregoing gas turbine engine, the buffer manifold is configured to reduce the pressure of the flow of air from the high pressure compressor.

In a further non-limiting embodiment of any of the foregoing gas turbine engines, a first portion of the flow of air from the high pressure compressor flows over the first and second air seals, and a second portion of the flow of air from the high pressure compressor flows through the buffer manifold.

In a further non-limiting embodiment of any of the foregoing gas turbine engines, the buffer manifold is fluidly coupled to a first tube and a second tube, the first tube is fluidly coupled between the buffer manifold and a location between the first air seal and the first oil seal, and the second tube is fluidly coupled between the buffer manifold and a location between the second air seal and the second oil seal.

In a further non-limiting embodiment of any of the foregoing gas turbine engines, the buffer manifold includes an orifice plate having an orifice, and the second portion of the flow of air from the high pressure compressor flows through the orifice.

In a further non-limiting embodiment of any of the foregoing gas turbine engines, the orifice is sized such that the second portion of the flow from the high pressure compressor has a reduced pressure downstream of the orifice.

In a further non-limiting embodiment of any of the foregoing gas turbine engines, inlets of the first and second tubes are downstream of the orifice plate.

In a further non-limiting embodiment of any of the foregoing gas turbine engines, a first plenum is between the first air seal and the first oil seal, and a second plenum is between the second air seal and the second oil seal.

In a further non-limiting embodiment of any of the foregoing gas turbine engines, the first tube is fluidly coupled to the first plenum and the second tube is fluidly coupled to the second plenum.

In a further non-limiting embodiment of any of the foregoing gas turbine engines, an inlet to the buffer manifold is radially outward of an interface between the first air seal and the first shaft, and radially outward of an interface between the second air seal and the second shaft.

In a further non-limiting embodiment of any of the foregoing gas turbine engines, the first and second shafts are rotatably supported by a plurality of bearings contained within the bearing compartment.

In a further non-limiting embodiment of any of the foregoing gas turbine engines, the first shaft interconnects a low pressure compressor and a low pressure turbine, and the second shaft interconnects a high pressure compressor and a high pressure turbine.

A system for a gas turbine engine according to an exemplary aspect of the present disclosure includes a buffer manifold in an intershaft region between first and second concentric shafts. The buffer manifold is configured to direct a flow of air between a first air seal and a first oil seal, and to direct another flow of air between a second air seal and a second oil seal.

In a further non-limiting embodiment of the foregoing system, a high pressure compressor is configured to provide a flow of air to the intershaft region, and the buffer manifold is configured to reduce the pressure of the flow of air from the high pressure compressor.

In a further non-limiting embodiment of any of the foregoing systems, a first portion of the flow of air from the high pressure compressor flows over the first and second air seals, and a second portion of the flow of air from the high pressure compressor flows through the buffer manifold.

In a further non-limiting embodiment of any of the foregoing systems, the buffer manifold is fluidly coupled to a first tube and a second tube, the first tube fluidly coupled between the buffer manifold and a location between the first air seal and the first oil seal, the second tube fluidly coupled between the buffer manifold and a location between the second air seal and the second oil seal.

In a further non-limiting embodiment of any of the foregoing systems, the buffer manifold includes an orifice plate having an orifice, and the second portion of the flow of air from the high pressure compressor flows through the orifice.

In a further non-limiting embodiment of any of the foregoing systems, the orifice is sized such that the second portion of the flow from the high pressure compressor has a reduced pressure downstream of the orifice.

In a further non-limiting embodiment of any of the foregoing systems, inlets of the first and second tubes are downstream of the orifice plate.

In a further non-limiting embodiment of any of the foregoing systems, a first plenum is between the first air seal and the first oil seal, and a second plenum is between the second air seal and the second oil seal. Further, the first tube is fluidly coupled to the first plenum and the second tube is fluidly coupled to the second plenum.

The embodiments, examples and alternatives of the preceding paragraphs, the claims, or the following description and drawings, including any of their various aspects or respective individual features, may be taken independently or in any combination. Features described in connection with one embodiment are applicable to all embodiments, unless such features are incompatible.

DETAILED DESCRIPTION

Figure 1:
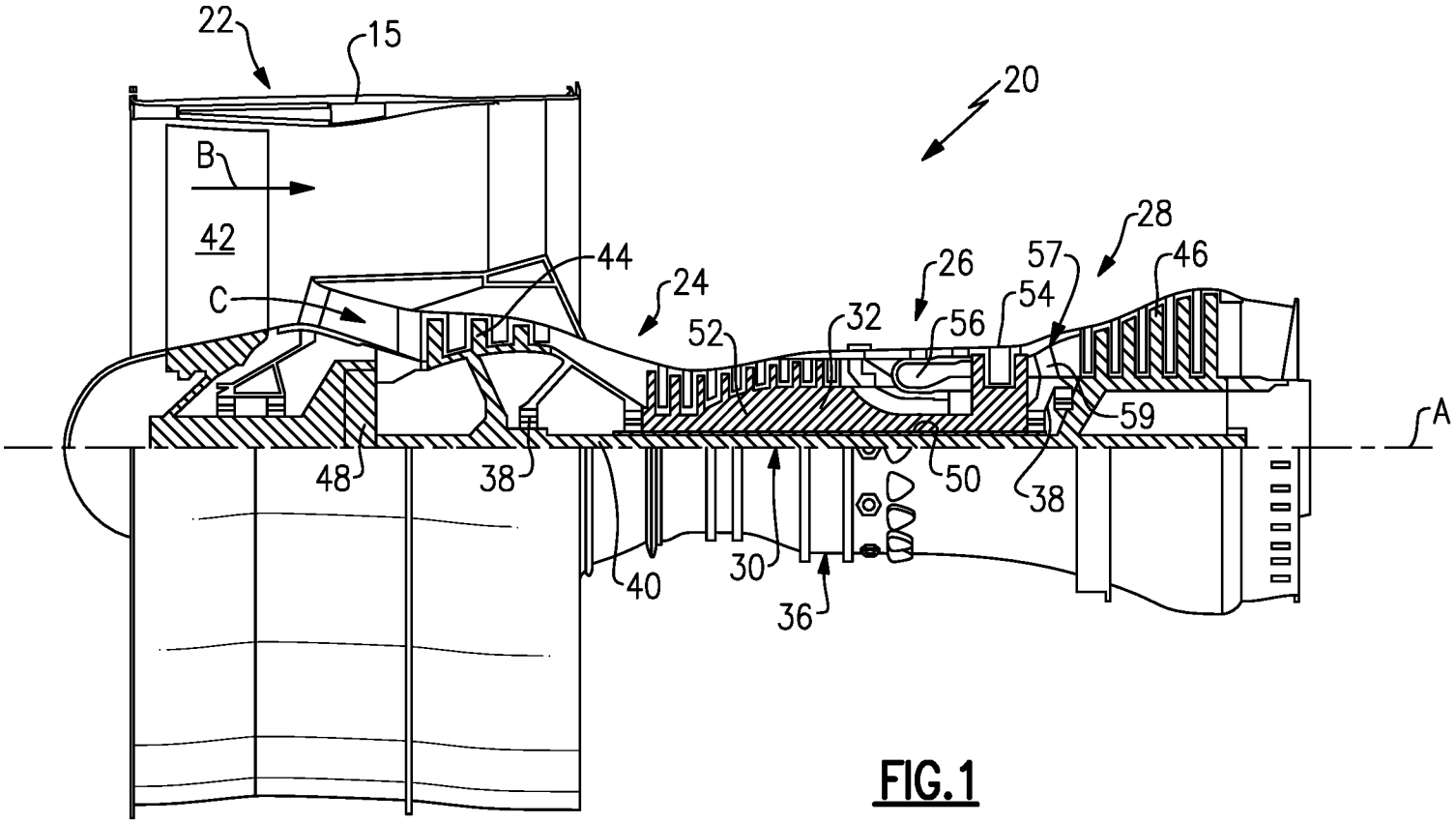
FIG. 1 schematically illustrates a gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. The fan section 22 drives air along a bypass flow path B in a bypass duct defined within a nacelle 15, and also drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects, a first (or low) pressure compressor 44 and a first (or low) pressure turbine 46. The inner shaft 40 is connected to the fan 42 through a speed change mechanism, which in exemplary gas turbine engine 20 is illustrated as a geared architecture 48 to drive a fan 42 at a lower speed than the low speed spool 30. The high speed spool 32 includes an outer shaft 50 that interconnects a second (or high) pressure compressor 52 and a second (or high) pressure turbine 54. A combustor 56 is arranged in exemplary gas turbine 20 between the high pressure compressor 52 and the high pressure turbine 54. A mid-turbine frame 57 of the engine static structure 36 may be arranged generally between the high pressure turbine 54 and the low pressure turbine 46. The mid-turbine frame 57 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The mid-turbine frame 57 includes airfoils 59 which are in the core airflow path C. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of the low pressure compressor, or aft of the combustor section 26 or even aft of turbine section 28, and fan 42 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five 5:1. Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1 and less than about 5:1. It should be understood, however, that the above parameters are only exemplary of one embodiment of a geared architecture engine and that the present invention is applicable to other gas turbine engines including direct drive turbofans, low bypass engines, and multi-stage fan engines.

A significant amount of thrust is provided by the bypass flow B due to the high bypass ratio. The fan section 22 of the engine 20 is designed for a particular flight condition—typically cruise at about 0.8 Mach and about 35,000 feet (10,668 meters). The flight condition of 0.8 Mach and 35,000 ft (10,668 meters), with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of $[(\text{Tram}\ ^\circ\ \text{R})/(518.7^\circ\ \text{R})]^{0.5}$. The "Low corrected fan tip speed" as disclosed herein according to one non-limiting embodiment is less than about 1150 ft/second (350.5 meters/second).

Figure 2:
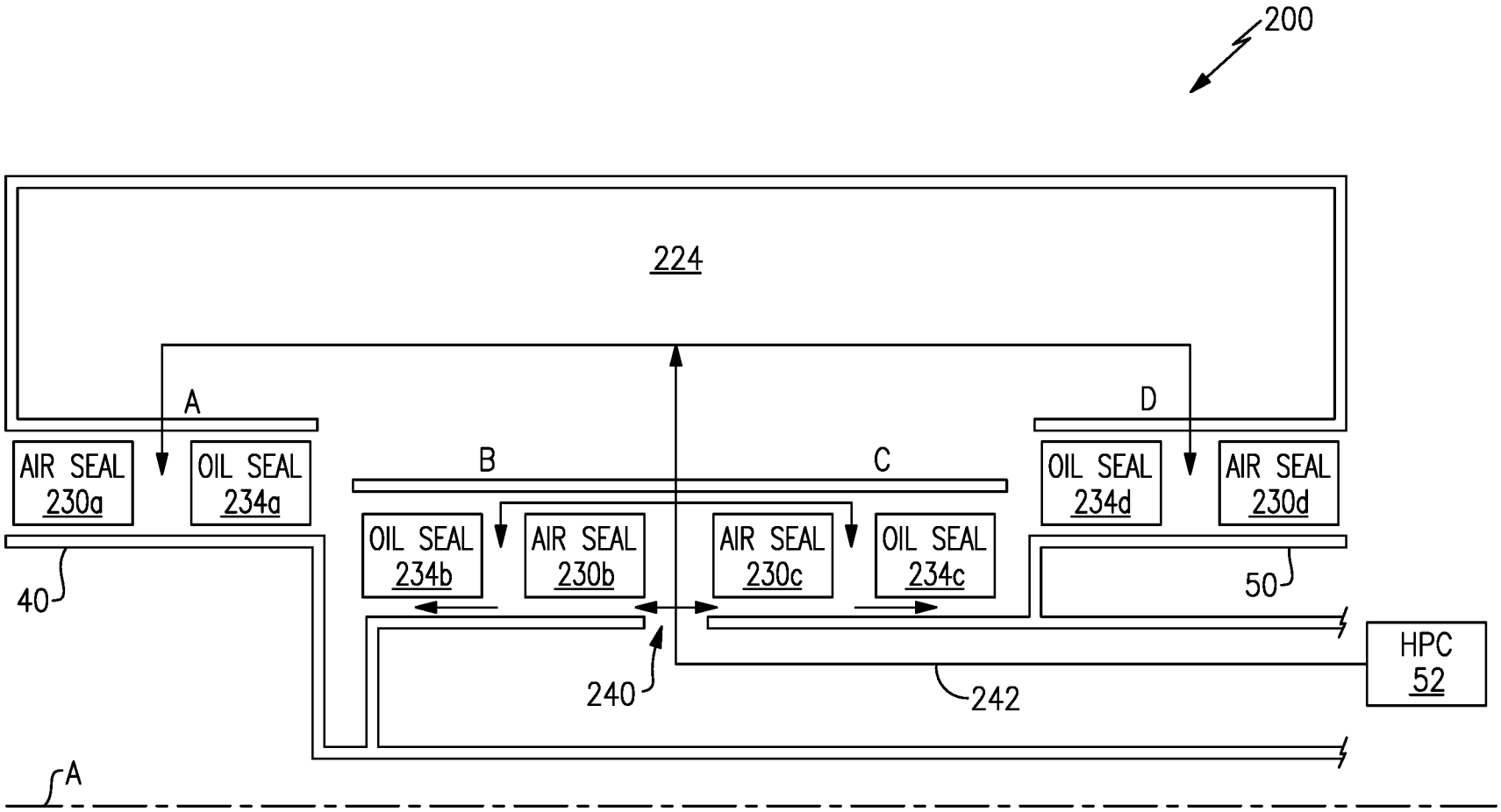
FIG. 2 schematically illustrates a buffer system according to this disclosure.

In this disclosure, the engine 20 includes a buffer system 200, which is illustrated schematically in FIG. 2. The buffer system 200 is illustrated with respect to the engine central longitudinal axis A. The buffer system 200 is shown as part of a two-spool configuration that includes the inner shaft 40 and the outer shaft 50. The inner and outer shafts 40, 50 are rotatably supported by a plurality of bearings contained within a bearing compartment 224. While a two-spool configuration is shown, this disclosure is not limited to two-spool configurations. The buffer system 200 could be used in three-spool configurations, for example.

In FIG. 2, various locations of the engine 20 are denoted by letters A, B, C, and D. At each of these locations A-D, a pair of seals are shown. Each pair of seals includes an air seal and an oil seal. The seals are used in the buffer system 200 to isolate a fluid from one or more regions of the engine 20. In particular, the seals are used to retain lubricating fluid (i.e., oil) within the bearing compartment 224.

At location A, an air seal 230*a* and an oil seal 234*a* are shown. Each of the seals comprises a radially interior side/surface and radially outer side/surface. At location B, an air seal 230*b* and an oil seal 234*b* are shown. At location C, an air seal 230*c* and an oil seal 234*c* are shown. At location D, yet another air seal 230*d* and oil seal 234*d* are shown. Each of the seals can be provided by circumferentially segmented seals extending circumferentially about the engine central longitudinal axis A. In one example, each of the air seals 230*a*-230*d* are provided by the same type of seal, and the oil seals 234*a*-234*d* are also provided by the same type of seal, albeit a different type than the air seals 230*a*-230*d*.

The seals 230*a* and 234*a* are used to seal the bearing compartment 224 with respect to the inner shaft 40. The seals 230*d* and 234*d* are used to seal the bearing compartment 224 with respect to the outer shaft 50. The seals 230*b*, 234*b*, 230*c*, and 234*c* are also used to seal the bearing compartment 224 with respect to the inner and outer shafts 40, 50, but in particular these seals are used to provide sealing between the inner and outer shafts 40, 50, in an intershaft region 240 where the inner and outer shafts 40, 50 interact with or surround one another. In this particular example, there is a gap between the inner and outer shafts 40, 50 (i.e., the inner and outer shafts 40, 50 are axially spaced-apart from one another) through which fluid may flow.

With continued reference to FIG. 2, a radially outer side (the term "radially" refers to a direction normal to the engine central longitudinal axis A) of air seal 230*b* may be fixed to a radially inner surface of the bearing compartment 224, and a radially inner surface of the air seal 230*b* interfaces with the inner shaft 40. Air flow, such as leakage flow, over the air seal 230*b*, and specifically between the radially inner surface of the air seal 230*h* and the inner shaft 40, establishes a seal between the air seal 230*b* and the inner shaft 40. The radially outer surface of the oil seal 234*b* may likewise be fixed to the radially inner surface of the bearing compartment 224, and air is configured to flow between the radially inner surface of the oil seal 234*b* and the inner shaft 40. The air seal 230*c* and oil seal 234*c* are arranged in substantially the same way, except they are provided on an axially opposite side of an intershaft region 240 and are configured to seal relative to the outer shaft 50 as opposed to the inner shaft 40.

A buffer source provides air to each pair of air seals and oil seals at the respective locations A-D. In some known engines, the buffer source may originate from one or more stages of the low pressure compressor 40, such as for example an axially aft-most stage of the low pressure compressor. However, in this disclosure, the buffer source originates from the high pressure compressor 52, which provides air at a greater pressure than the air pressure associated with the low pressure compressor 40. The buffer source of air is represented in the box labeled "HPC," which stands for high pressure compressor 52, in FIG. 2.

In general, air 242 flows from the buffer source, which again is the high pressure compressor 52, to the intershaft region 240. As will be appreciated below from FIG. 3, a portion of the air 242 flows over the air seals 230*b* and 230*c*, while another, reduced-pressure portion is directed downstream of the air seals 230*b*, 230*c* and flows across the oil seals 234*b*, 234*c*. Optionally, any remaining air flows to locations A and D, as generally shown in FIG. 2. As an additional option, excess air might be directed to other low pressure sink locations, including overboard bleeds, the core compartment, or locations along the main gas path.

Figure 3:
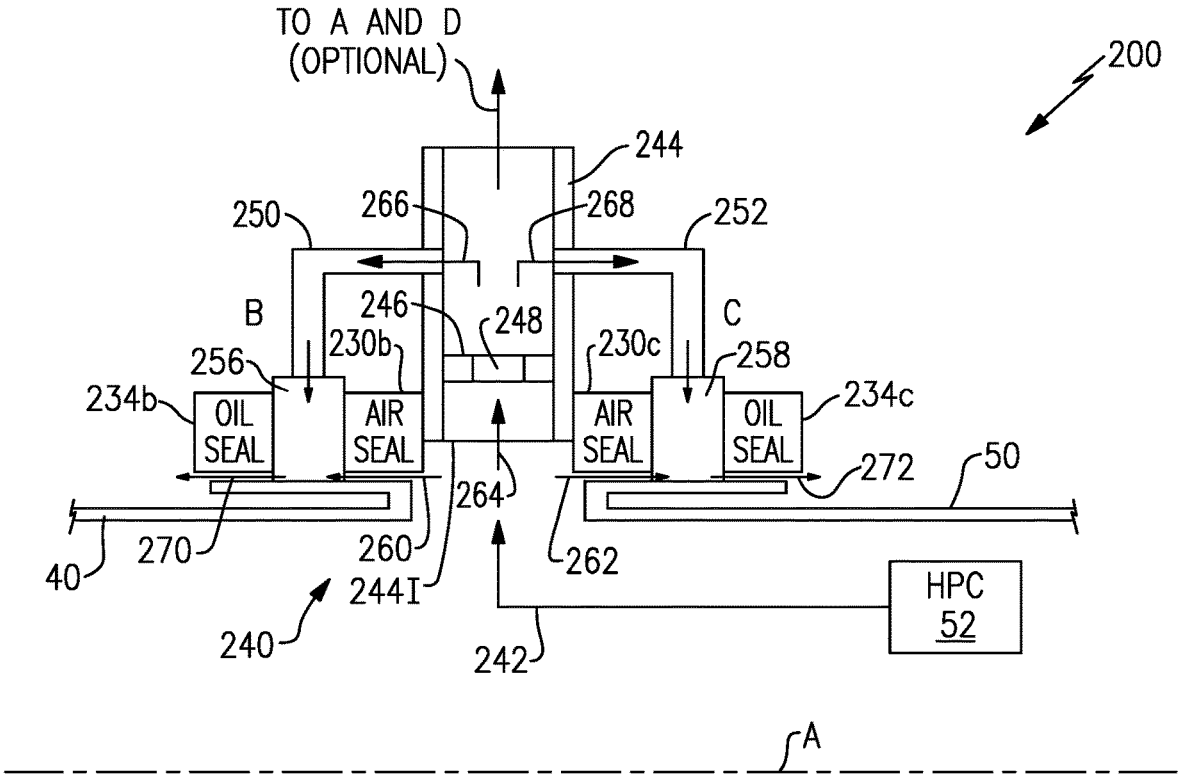
FIG. 3 schematically illustrates additional detail of the intershaft region of the buffer system of FIG. 2.

FIG. 3 illustrates the detail of the buffer system 200 in the intershaft region 240. In this disclosure, the buffer system 200 includes a buffer manifold 244 in the intershaft region 240. An inlet 244I to the buffer manifold 244 is downstream of, and radially outward of, the interfaces between the air seals 230*b*, 230*c* and the respective inner and outer shafts 40, 50. The buffer manifold 244 may be provided by a tube or arranged as a plenum. In general, the buffer manifold 244 projects in a radial direction normal to the engine central longitudinal axis A.

In this disclosure, the buffer manifold 244 includes an orifice plate 246, which is a relatively thin plate mounted inside the wall(s) of the buffer manifold 244, and which has an orifice 248. The orifice 248 is smaller in diameter than the remainder of the buffer manifold 244. Thus, as air flows through the orifice 248, its pressure builds slightly upstream of the orifice 248, and as the air 242 converges and passes through the orifice 248 its velocity increases and its pressure decreases. Accordingly, the pressure of air downstream of the orifice plate 246 is reduced relative to the pressure of the air upstream of the orifice plate 246. That said, the orifice 248 is sized such that the pressure does not fall below the pressure of the fluid inside the bearing compartment 224. While an orifice plate 246 is shown in the drawings, this disclosure extends to other types of flow metering devices and is not limited to orifice plates.

Downstream of the orifice plate 246, first and second tubes 250, 252 fluidly couple the buffer manifold 244 to locations between the air seals 230*b*, 230*c* and the respective oil seals 234*b*, 234*c*. Specifically, the first tube 250 is fluidly coupled between the buffer manifold 244 and a first plenum 256 arranged axially between the air seal 230*b* and the oil seal 234*b*. Likewise, the second tube 252 is fluidly coupled between the buffer manifold 244 and a second plenum 258 arranged axially between the air seal 230*b* and the oil seal 234*b*. The inlets to the first and second tubes 250, 252 are downstream of the orifice plate 246, and thus the first and second tubes 250, 252 are supplied with reduced-pressure air flows. In this example, the first and second tubes 250, 252 are configured to direct flow from the buffer manifold 244 in an axial direction parallel to the engine central longitudinal axis A, and to then turn that flow in a radial direction toward the engine central longitudinal axis A and ultimately to the first and second plenums 256, 258. Within the first and second plenums 256, 258, the air that has flowed over the air seals 230*b*, 230*c* is combined with the air from downstream of the orifice plate 246, and the combined flows flow over the respective oil seals 234*b*, 234*c*.

During use of the engine 20, air 242 from the buffer source is directed to the intershaft region 240. A first portion of the air 242 splits into airflows 260, 262 and flows over respective air seals 230*b*, 230*c*. Namely, the airflow 260 flows between the air seal 230*b* and the inner shaft 40, and the airflow 262 flows between the air seal 230*c* and the outer shaft 50.

A second portion 264 of the air 242, which is a portion of the air 242 that did not flow over the seals 230*b*, 230*c* (i.e., air 242 less airflows 260, 262), enters the buffer manifold 244 and flows through the orifice 248. As such, the second portion 264 exhibits a reduced pressure downstream of the orifice 248. Some or all of the second portion 264 becomes airflows 266, 268 in the first and second tubes 250, 252, respectively. In one example, the buffer manifold 244 has a closed end and causes all of the second portion 264 to essentially split into the airflows 266, 268. In another example, the buffer manifold 244 is fluidly coupled to the downstream locations A and D, and thus some of the second portion 264 does not enter the first and second tubes 250, 252, and instead continues downstream toward the locations A and/or D.

The airflow 266 intermixes with the airflow 260 within the first plenum 256. In the first plenum 256, the pressure of the airflow 260 is reduced relative to that of the air 242 by virtue of the air seal 230*b*. The combined airflow 270 flows over the oil seal 234*b* and into the bearing compartment 224. Likewise, the airflow 268 intermixes with the airflow 262 within the second plenum 258, and the combined airflow 272 flows over the oil seal 234*c* and into the bearing compartment 224.

In this disclosure, only a portion of the air 242, which is relatively high pressure, flows over the air seals 230*b*, 230*c*. Further, by providing air into the first and second plenums 256, 258 via the first and second tubes 250, 252, the pressure drop over the air and oil seals 230*b*, 230*c*, 234*b*, 234*c* is lessened, which prevents degradation and increases the life of the seals. While the disclosed arrangement provides less airflow over the air seals 230*b*, 230*c*, the arrangement provides a relatively high level of airflow to the oil seals 234*b*, 234*c* via the first and second tubes 250, 252. Thus, the buffer system 200 allows the oil seals 234*b*, 234*c* to operate efficiently while also prolonging the life of the air seals 230*b*, 230*c*. Further, as the air seals 230*b*, 230*c* degrade over time, increased leakage over the air seals 230*b*, 230*c* will replace the flow through the first and second tubes 250, 252, and will only cause a minor change in the pressure of the airflow over the oil seals 234*b*, 234*c*, which ensures consistent pressurization of the oil seals 234*b*, 234*c*.

It should be understood that terms such as "axial" and "radial" are used above with reference to the normal operational attitude of the engine 20. Further, these terms have been used herein for purposes of explanation, and should not be considered otherwise limiting. Terms such as "generally," "substantially," and "about" are not intended to be boundaryless terms, and should be interpreted consistent with the way one skilled in the art would interpret those terms.

Although the different examples have the specific components shown in the illustrations, embodiments of this disclosure are not limited to those particular combinations. It is possible to use some of the components or features from one of the examples in combination with features or components from another one of the examples. In addition, the various figures accompanying this disclosure are not necessarily to scale, and some features may be exaggerated or minimized to show certain details of a particular component or arrangement.

One of ordinary skill in this art would understand that the above-described embodiments are exemplary and non-limiting. That is, modifications of this disclosure would come within the scope of the claims. Accordingly, the following claims should be studied to determine their true scope and content.

The invention claimed is:

1. A gas turbine engine, comprising:

a high pressure compressor configured to provide a flow of air to an intershaft region between a first shaft and a second shaft concentric with the first shaft;

a bearing compartment;

a first air seal configured to seal between the first shaft and the bearing compartment;

a first oil seal configured to seal between the first shaft and the bearing compartment;

a second air seal configured to seal between the second shaft and the bearing compartment;

a second oil seal configured to seal between the second shaft and the bearing compartment;

a buffer manifold in the intershaft region, wherein a first portion of the flow of air from the high pressure compressor flows over the first and second air seals, and a second portion of the flow of air from the high pressure compressor flows through the buffer manifold, wherein the buffer manifold is fluidly coupled to a first tube and a second tube, the first tube fluidly coupled between the buffer manifold and a first plenum between the first air seal and the first oil seal, and the second tube fluidly coupled between the buffer manifold and a second plenum between the second air seal and the second oil seal, wherein the buffer manifold includes an orifice plate having an orifice, and wherein the second portion of the flow of air from the high pressure compressor flows through the orifice, wherein inlets of the first and second tubes are downstream of the orifice plate, wherein the gas turbine engine is arranged such that fluid exiting the first and second tubes is combined, within a respective one of the first and second plenums, with fluid that has flowed over a respective one of the first and second air seals, and such that the combined fluids flow over a respective one of the first and second oil seals.

2. The gas turbine engine as recited in claim 1, wherein the buffer manifold is configured to reduce the pressure of the flow of air from the high pressure compressor.

3. The gas turbine engine as recited in claim 1, wherein the orifice is sized such that the second portion of the flow from the high pressure compressor has a reduced pressure downstream of the orifice.

4. The gas turbine engine as recited in claim 1, wherein an inlet to the buffer manifold is radially outward of an interface between the first air seal and the first shaft, and radially outward of an interface between the second air seal and the second shaft.

5. The gas turbine engine as recited in claim 1, wherein the first and second shafts are rotatably supported by a plurality of bearings contained within the bearing compartment.

6. The gas turbine engine as recited in claim 5, wherein the first shaft interconnects a low pressure compressor and a low pressure turbine, and the second shaft interconnects a high pressure compressor and a high pressure turbine.

7. A system for a gas turbine engine, comprising:

a buffer manifold in an intershaft region between first and second concentric shafts, wherein the buffer manifold is configured to direct a flow of air between a first air seal and a first oil seal, and to direct another flow of air between a second air seal and a second oil seal;

a high pressure compressor configured to provide a flow of air to the intershaft region, wherein the buffer manifold is configured to reduce the pressure of the flow of air from the high pressure compressor, wherein a first portion of the flow of air from the high pressure compressor flows over the first and second air seals, and a second portion of the flow of air from the high pressure compressor flows through the buffer manifold, wherein the buffer manifold is fluidly coupled to a first tube and a second tube, the first tube fluidly is coupled between the buffer manifold and a first plenum between the first air seal and the first oil seal, and the second tube is fluidly coupled between the buffer manifold and a second plenum between the second air seal and the second oil seal, wherein the buffer manifold includes an orifice plate having an orifice, and the second portion of the flow of air from the high pressure compressor flows through the orifice, wherein the orifice is sized such that the second portion of the flow from the high pressure compressor has a reduced pressure downstream of the orifice, wherein inlets of the first and second tubes are downstream of the orifice plate, wherein the system is arranged such that fluid exiting the first and second tubes is combined, within a respective one of the first and second plenums, with fluid that has flowed over a respective one of the first and second air seals, and such that the combined fluids flow over a respective one of the first and second oil seals.

8. The system as recited in claim 7, wherein the orifice is sized such that the second portion of the flow from the high pressure compressor has a reduced pressure downstream of the orifice.

* * * * *